US005390600A

United States Patent [19]

Thünker

[11] Patent Number: 5,390,600

[45] Date of Patent: Feb. 21, 1995

[54] SHEET GRIPPER DEVICE ON A PAPER-GUIDING CYLINDER OF A SHEET-FED PRINTING PRESS

[75] Inventor: Norbert Thünker, Hirschberg, Germany

[73] Assignee: Heidelberger Druckmaschinen AG, Heidelberg, Germany

[21] Appl. No.: 95,929

[22] Filed: Jul. 22, 1993

[30] Foreign Application Priority Data

Jul. 22, 1992 [DE] Germany ..... 4224189
May 12, 1993 [DE] Germany ..... 4315844

[51] Int. Cl.[6] ..... B41F 21/00

[52] U.S. Cl. ..... 101/408; 271/206; 271/277; 271/82

[58] Field of Search ..... 101/408, 409, 410, 411, 101/412, 415.1; 271/204, 206, 277, 82

[56] References Cited

U.S. PATENT DOCUMENTS

| | | | |
|---|---|---|---|
| 2,418,065 | 3/1947 | Bobst | 101/408 |
| 3,650,211 | 3/1972 | Nentwich | 271/82 |
| 4,486,061 | 7/1989 | Jeselike et al. . | |
| 4,501,415 | 2/1985 | Loebach | 271/82 |
| 4,592,279 | 6/1986 | Kemmerer . | |
| 4,864,929 | 9/1989 | Simeth | 101/409 |
| 5,199,757 | 4/1993 | Simeth | 101/409 |
| 5,222,727 | 6/1993 | Jacobsen | 271/277 |

FOREIGN PATENT DOCUMENTS

| | | | |
|---|---|---|---|
| 1804742 | 12/1958 | Germany . | |
| 1231726 | 1/1967 | Germany | 271/206 |
| 2157892 | 5/1973 | Germany . | |
| 2422343 | 12/1974 | Germany | 101/408 |
| 3529612 | 2/1987 | Germany | 101/415.1 |
| 0300043 | 12/1990 | Japan | 271/82 |
| 0709392 | 1/1980 | U.S.S.R. | 101/409 |

*Primary Examiner*—Eugene H. Eickholt
*Attorney, Agent, or Firm*—Herbert L. Lerner; Laurence A. Greenberg

[57] ABSTRACT

Sheet gripper device on a paper-guiding cylinder of a sheet-fed printing press includes a sheet gripper formed of a leaf spring and having a gripper tip located at an end thereof, a gripper pad engageable by the gripper tip, a control shaft for the gripper tip, the control shaft being actuatable so as to swivel about a longitudinal axis thereof, the leaf spring having another end opposite the end thereof whereon the gripper tip is located and being fastened by the other end thereof on the cylinder, an adjustable thrust member and means for holding the thrust member, the holding means being mounted on the control shaft so as to be fixed against rotation relative thereto, the thrust member being effective against the leaf spring during a swiveling movement of the control shaft in a closing direction of the sheet gripper; and the sheet gripper per se.

12 Claims, 4 Drawing Sheets

SHEET GRIPPER DEVICE ON A PAPER-GUIDING CYLINDER OF A SHEET-FED PRINTING PRESS

The invention relates to a sheet gripper device on a paper-guiding cylinder of a sheet-fed printing press and, more particularly, to such a sheet gripper device having a sheet gripper formed of a leaf spring and a gripper tip or finger located at an end thereof, a gripper pad engageable by the gripper tip, and a control shaft for the gripper tip, the control shaft being actuatable so as to swivel about a longitudinal axis thereof.

From German Patent 36 44 484, a sheet gripper device of this general type has become known heretofore wherein the other end of the leaf spring, i.e., the end thereof directed opposite to the end thereof at which the gripper tip or finger is located, is connected, respectively, to a control shaft and to a holder fastened to the control shaft. The leaf-spring end at which the gripper tip or finger is located is additionally loaded by a spring braced against the holder so that the gripper tip or finger is held on a gripper pad against a setscrew for regulating the instant of time at which the gripper closes, i.e., at which the gripper tip or finger engages the gripper pad with gripping force. The gripper tip is lifted away from the gripper pad due to a swiveling of the control shaft in one rotary direction and, due to a swivelling of the control shaft in the opposite rotary direction, the gripper tip is initially brought into contact with the gripper pad so that, upon further swiveling of the control shaft in the same rotary direction, a holding or gripping force is exerted upon the gripper pad. The leaf spring accordingly lifts away from the setscrew. Such a conventional sheet gripper device causes undesired noises primarily at high speeds and causes errors in register, because unavoidable play in the mounting support or bearings and in the drive of the control shaft has a disadvantageous effect.

It is an object of the invention to provide an improvement in a sheet gripper device of the general type described in the introduction hereto which primarily permits the sheet gripper to operate absolutely free of any play, and permits a reliable, registered sheet transfer also at high press speeds.

With the foregoing and other objects in view, there is provided, in accordance with the invention, a sheet gripper device on a paper-guiding cylinder of a sheet-fed printing press, comprising a sheet gripper formed of a leaf spring and having a gripper tip located at an end thereof, a gripper pad engageable by the gripper tip, a control shaft for the gripper tip, the control shaft being actuatable so as to swivel about a longitudinal axis thereof, the leaf spring having another end opposite the end thereof whereon the gripper tip is located and being fastened by the other end thereof on the cylinder, an adjustable thrust member and means for holding the thrust member, the holding means being mounted on the control shaft so as to be fixed against rotation relative thereto, the thrust member being effective against the leaf spring during a swiveling movement of the control shaft in a closing direction of the sheet gripper.

A sheet gripper device with the foregoing structural features is directly connected to a paper-guiding cylinder. The movements of the gripper tip or finger when the gripper device is opened and closed are effected by deformations of the leaf spring. The gripper device is therefore absolutely free of play. Only the deformation of the leaf spring for closing and opening the gripper device is effected by the swiveling movement of the control shaft. The location of the central axis of the control shaft with respect to the locations at which the leaf spring and the gripper pad are affixed to the cylinder is selected so that the rotary angle of the control shaft between both extreme positions wherein the gripper device is open and closed, respectively, is equal to the change in the angle of the bending line of the leaf spring at a location at which a thrust member is effective against the leaf spring. The deflection of the leaf spring and the upward turning of the gripper tip are designed so that when the gripper holding force is applied the paper sheet is not slid or shifted between the gripper tip and the gripper pad. In a printing press, the leaf springs of all of the sheet gripper devices of a paper-guiding cylinder exert such a great restoring moment or torque upon the control shaft that no further springs are required to ensure the provision of a force-locking connection between a cam roller and a control cam. In this regard, it is noted that a force-locking connection is one which connects two elements together by force external to the elements, as opposed to a form-locking connection which is provided by the shapes of the elements themselves.

The construction of the sheet gripper device according to the invention is of particular advantage in that only the gripper tip is suddenly stopped when the gripper device is closing and accelerated when opening, respectively, so that the heretofore extremely disadvantageous noise development due to mass acceleration is considerably reduced and an in-register sheet transfer and a printing free of ghosting or slur are possible at high press speeds.

Assembly of the sheet gripper device quite readily possible without removing the control shaft. For adjusting the gripper closing point, a setscrew disposed in the holder substantially perpendicularly to the leaf spring is advantageously provided instead of the aforementioned thrust member, the setscrew being guided advantageously in a recess formed in the leaf spring and ensuring additional stabilization of the leaf spring transversely to the sheet travel direction. During opening and closing of the sheet gripper device, the contact location of the setscrew on the leaf spring and the setscrew per se move on virtually identical paths. Possible deviations lie in the microrange, i.e., in the order of magnitude of microns, and may be compensated for by providing an insert of hard rubber, teflon or like material.

Another advantage of the construction according to the invention is that construction space remains available above the sheet gripper device for an arrangement in common with pincer grippers, for example, of a turning drum. Sheet gripper devices according to the invention are producible at low cost and are relatively easy to assemble.

More specific features of the invention are noted hereinafter.

Thus, in accordance with another feature of the invention, the leaf spring, in an open position of the sheet gripper, is subject to a prestressing acting in an opening direction of the sheet gripper.

In accordance with a further feature of the invention, the leaf spring is secured by threaded fastening means at the other end thereof to the cylinder and extends through an opening formed in the control shaft.

In accordance with an added feature of the invention, the thrust member is disposed between the holding means and the leaf spring and is formed of a setscrew screwable in the holding means substantially perpendicularly to the leaf spring.

In accordance with an additional feature of the invention, the setscrew is guidable in a recess formed in the leaf spring.

In accordance with yet another feature of the invention, the setscrew has a contact surface formed thereon, and an insert formed of material having limited elasticity is disposed between the contact surface of the setscrew and the leaf spring.

In accordance with yet a further feature of the invention, the longitudinal swivel axis of the control shaft is spaced such a distance from a location at which the other end of the leaf spring is fastened on the cylinder that a swivel angle of the control shaft between one extreme position thereof wherein the gripper is open and another extreme position thereof wherein the gripper is closed corresponds to a change in an angle of a bending line of the leaf spring.

In accordance with yet an added feature of the invention, the leaf spring, in plan view, has a substantially triangular profile, with the fastened other end thereof being wider than the end opposite thereto whereon the gripper tip is located.

In accordance with yet an additional feature of the invention, the fastened other end of the leaf spring is connected by crosspieces with the gripper tip.

In accordance with still another feature of the invention, the sheet gripper includes a plurality of mutually spaced gripper tips disposed in a row adjacent one another and formed on a common leaf spring.

In accordance with still a further feature of the invention, the leaf spring is formed of a continuous foot portion at the other end thereof fastened to the cylinder, and at least respective pairs of crosspieces connecting the foot portion with each of the gripper tips.

In accordance with still an added feature of the invention, the sheet gripper comprises a leaf spring formed with a profile substantially resembling an isosceles triangle, in plan view, and having a gripper tip formed at a vertex thereof disposed opposite a side thereof having means for fastening the leaf spring to a cylinder.

In accordance with still an additional feature of the invention, the side thereof having the fastening means is connected by crosspieces to the gripper tip.

In accordance with another feature of the invention, the sheet gripper comprises a leaf spring formed with a profile, in plan view, substantially resembling a plurality of isosceles triangles mutually connected at respective bases thereof and having respective gripper tips formed at respective vertices of the isosceles triangles disposed opposite the respective bases thereof.

In accordance with a concomitant feature of the invention, the leaf spring is formed, at the connected bases of the isosceles triangles, with a continuous foot portion having means thereon for fastening the leaf spring to a cylinder, and including at least respective pairs of crosspieces connecting the continuous foot portion with each of the gripper tips.

Other features which are considered as characteristic for the invention are set forth in the appended claims.

Although the invention is illustrated and described herein as embodied in a sheet gripper device on a paper-guiding cylinder of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
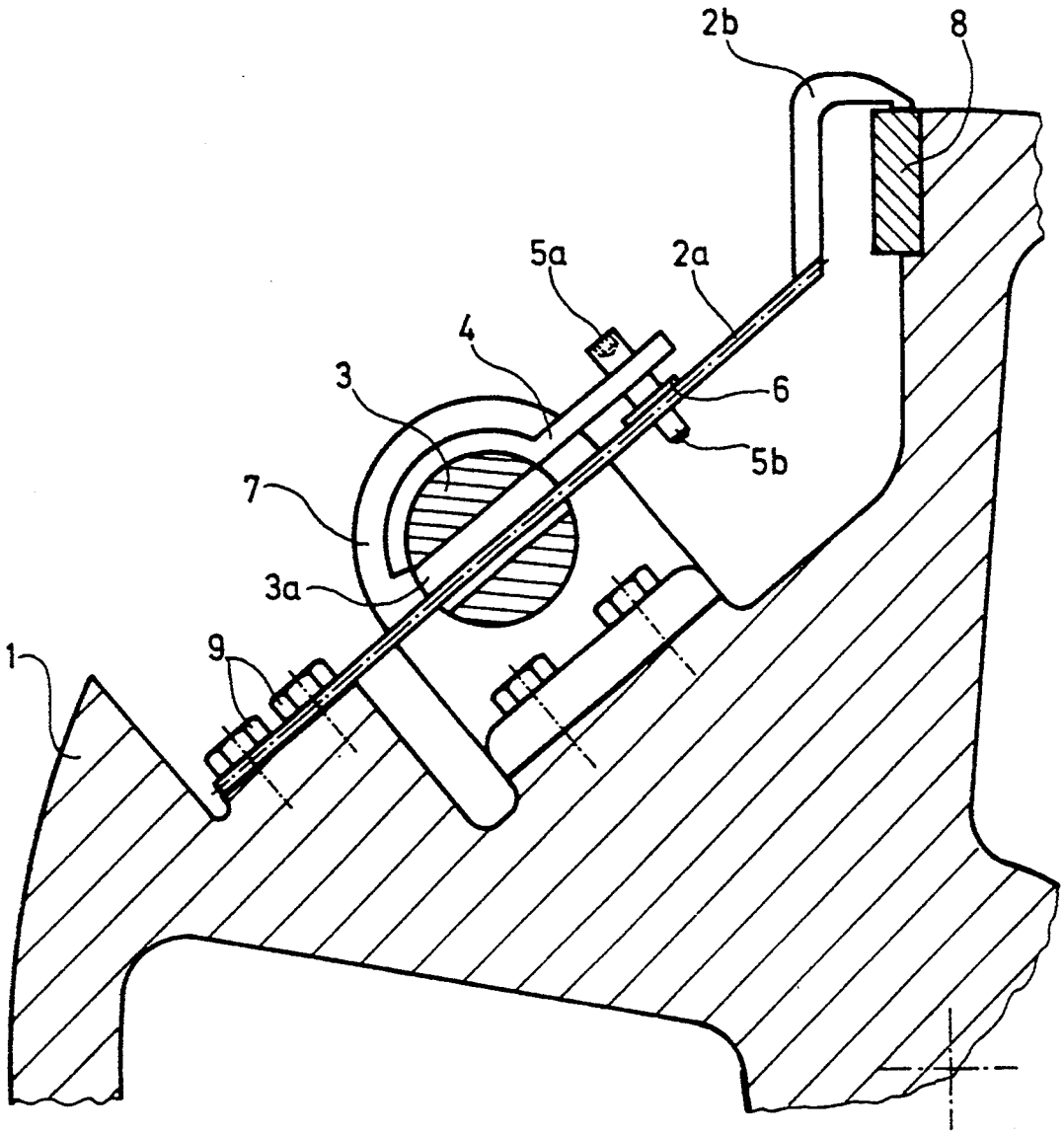
FIG. 1 is a cross-sectional view of a closed sheet gripper device constructed in accordance with the invention.
Figure 2:
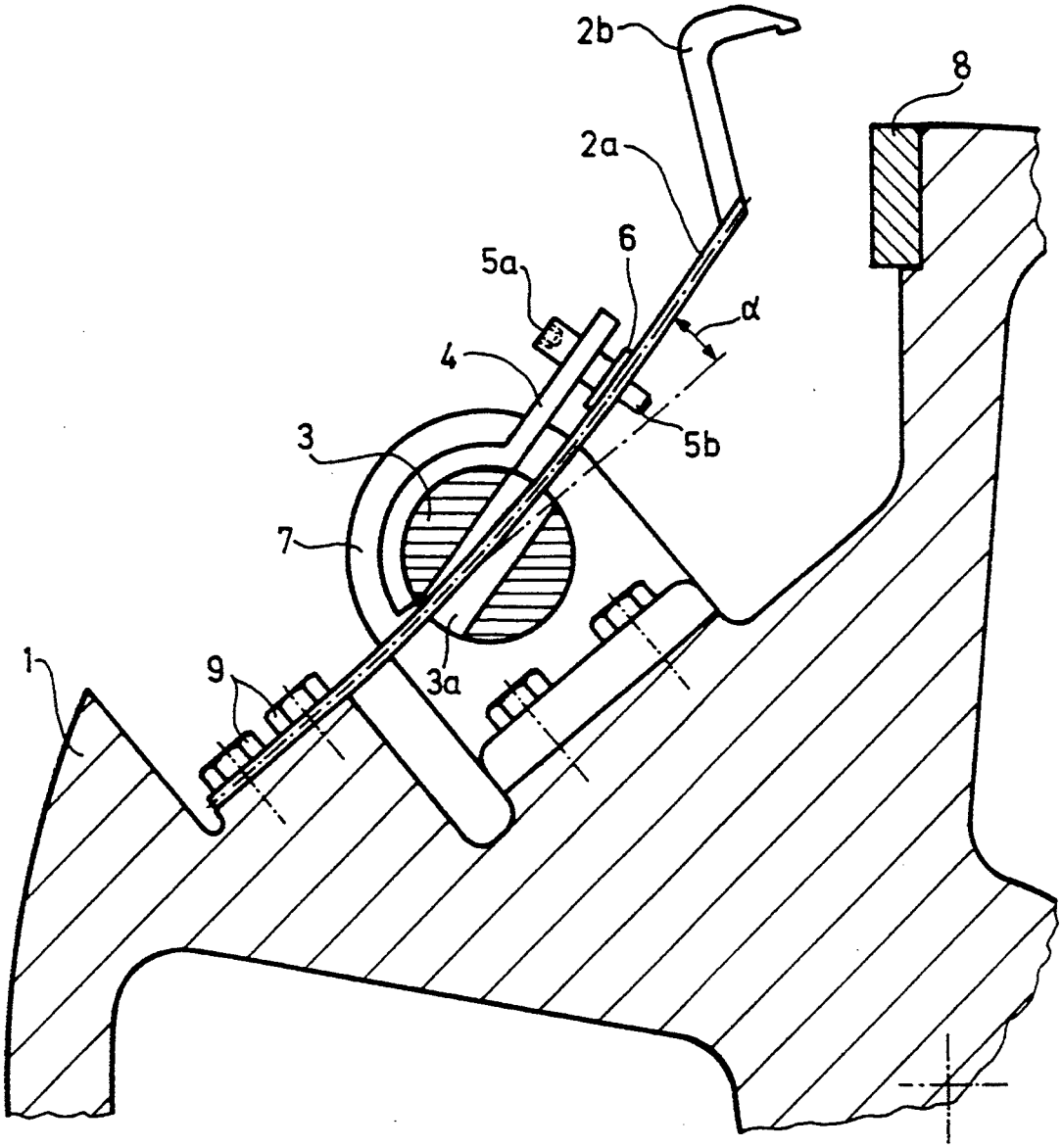
FIG. 2 is a view like that of FIG. 1 of an open sheet gripper device.

Referring now to the drawings and, first, particularly to FIGS. 1 and 2 thereof, there is shown therein a sheet gripper device for paper-guiding cylinders in sheet-fed printing presses which includes a sheet gripper formed of a leaf spring 2*a* and a gripper finger or tip 2*b* secured at one of the ends thereof, and a control shaft 3, which is swivelable about the longitudinal axis thereof for performing functions of opening and closing the sheet gripper device. In unstressed condition thereof, the leaf spring 2*a* is bent in a manner somewhat like that shown in FIG. 2. The gripper finger or tip 2*b* is firmly connected to the leaf spring 2*a* and integrally formed therewith, respectively. The leaf spring 2*a* extends through an opening 3*a* formed in the control shaft 3. An end of the leaf spring 2*a* directed away from the gripper finger or tip 2*b* is firmly attached by screws 9 to the cylinder 1.

FIG. 2 shows the sheet gripper device in the open position thereof, wherein the gripper finger or tip 2*b* is lifted away from a gripper pad 8 disposed on the cylinder 1. The control shaft 3 is reciprocatingly swiveled in a conventional manner in accordance with the operating cycle of the press by a roller lever, a cam roller and a control cam, none of which are illustrated because the specific construction thereof is not essential to the invention. A holder 4 is fastened to the control shaft 3 and transmits the movement of the control shaft 3 to the leaf spring 2*a* through the intermediary of a setscrew 5*a* acting as a thrust member. During the closing movement of the gripper device, a spring loading is formed in the leaf spring 2*a* which exerts a restoring torque on the control shaft 3. The relatively low spring rigidity of the leaf spring 2*a* has the effect that only relatively low driving momemts or torques are required for actuating the gripper. If the control shaft 3 is swiveled about a given rotary angle clockwise, the leaf spring 2*a* and the gripper finger or tip 2*b* come into the closed gripper-device position represented in FIG. 1.

The location of the central axis of the control shaft 3 is chosen so that the rotational or swivel angle of the control shaft 3 between the two extreme positions (closed gripper and open gripper) is equal to the change in the angle $\alpha$ of the deflection curve bending line of the leaf spring 2*a* at the location at which the setscrew 5*a* acts against the the leaf spring 2*a*. The support location of the leaf spring 2*a* and the setscrew 5*a* move along virtually identical paths with minimal deviations which can be compensated for by a washer 6 formed of hard rubber, teflon or similar material. The setscrew 5*a* is formed with a guide pin 5*b* at a tip thereof by which it projects through a bore formed in the leaf spring 2*a*, thereby particularly achieving lateral stability of the leaf spring 2*a*. The setscrew 5*a* serves for adjusting a uniform gripper closure for all of the grippers of a respective cylinder 1. The control shaft 3 is rotatably mounted or journalled in bearing blocks 7 disposed in the conventional gap formed in the cylinder 1.

Figure 3:
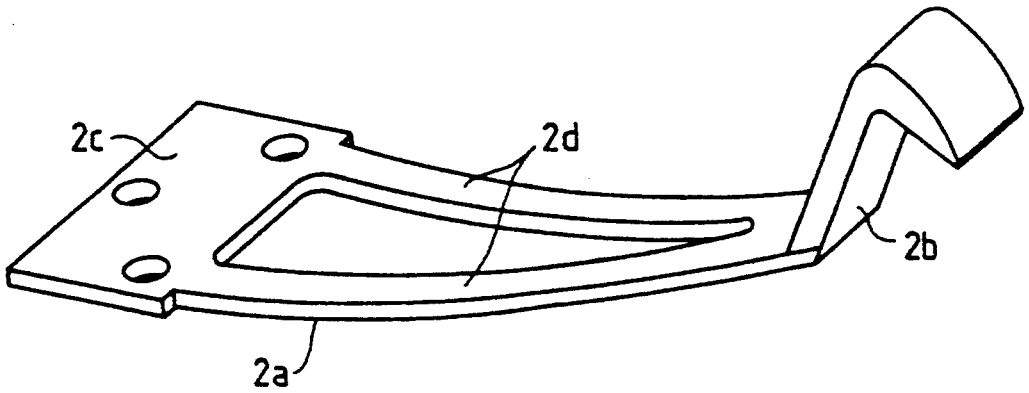
FIG. 3 is a top, side and front perspective view of an embodiment of a sheet gripper formed of one leaf spring and one gripper finger or tip.

A special construction of the leaf spring 2*a* is illustrated in FIG. 3. In accordance therewith, the leaf spring 2*a* has a somewhat triangular profile in a top plan view, so that it has a wider fastening end 2*c* when compared with the gripper finger or tip end 2*b*. In the embodiment illustrated in FIG. 3, a very great torsional rigidity or strength and a very great stability against lateral loading or stressing is achieved by a leaf spring 2*a* when the gripper finger or tip 2*b* is connected by bars or crosspieces 2*d* with the considerable wider fastening end 2*c*.

Figure 4:
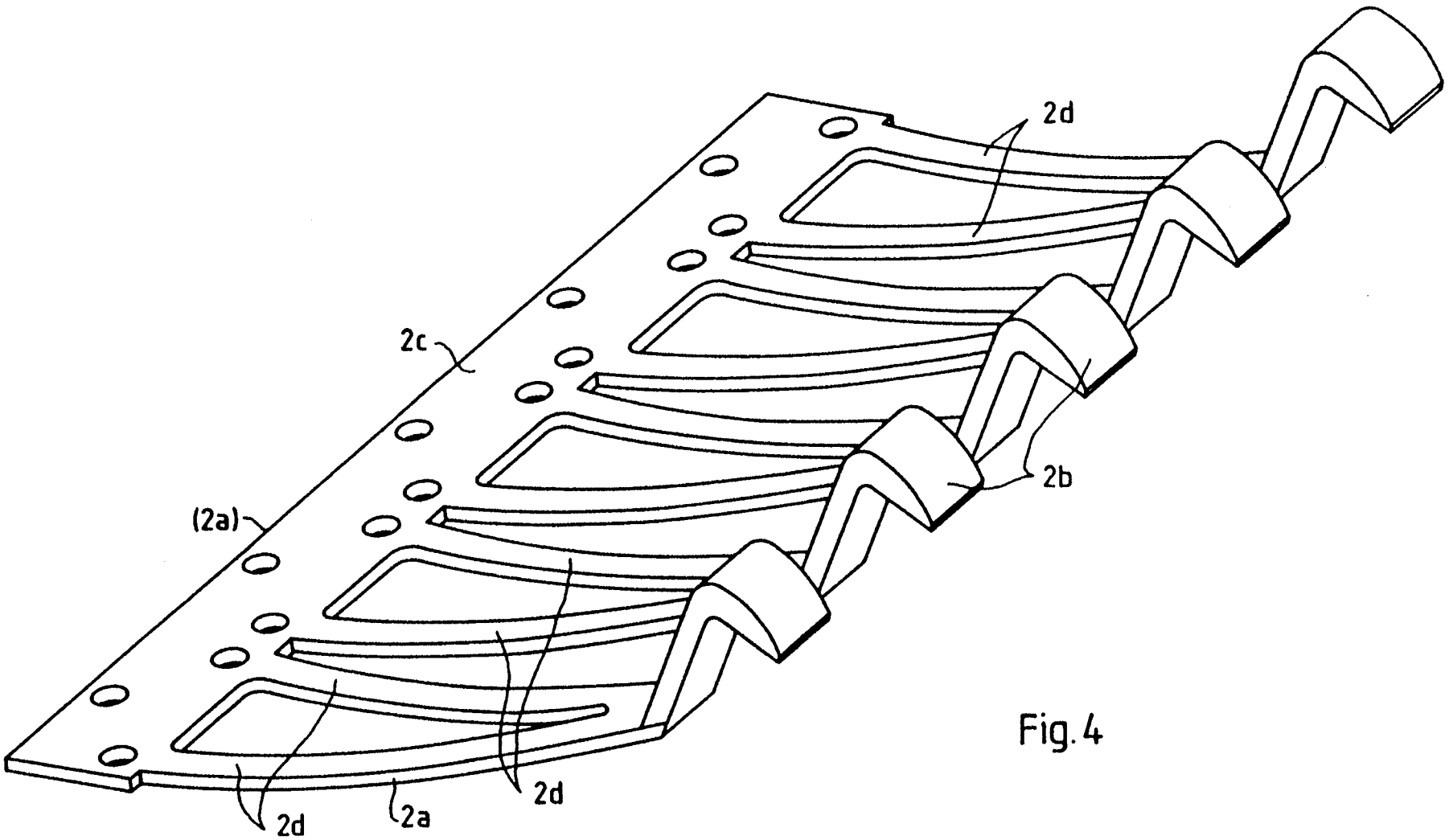
FIG. 4 is a view like that of FIG. 3 of another embodiment of the sheet gripper formed with several, namely, five, leaf springs and a row of five gripper fingers or tips, respectively, secured thereto.

Another embodiment of the sheet gripper 2*a*,2*b* is shown, by way of example, in FIG. 4. A plurality of gripper fingers or tips 2*b* are shown in a row adjacent to one another and formed integrally on a common plate also formed with corresponding leaf springs 2*a*. Respective pairs of crosspieces or bars 2*d* connect each of the gripper fingers or tips 2*b* with a strip-shaped common foot portion forming the fastening end 2*c*. Production costs are reduced and subsequent assembly is facilitated by the construction of the embodiment of FIG. 4.

I claim:

1. Sheet gripper device on a paper-guiding cylinder of a sheet-fed printing press, comprising a sheet gripper formed of a leaf spring and having a gripper tip located at an end thereof, a gripper pad engageable by said gripper tip, a control shaft for said gripper tip, said control shaft being actuatable so as to swivel about a longitudinal axis thereof, said leaf spring having another end opposite said end thereof whereon said gripper tip is located and being fastened by said other end thereof on the cylinder, an adjustable thrust member and means for holding said thrust member, said holding means being mounted on said control shaft so as to be fixed against rotation relative thereto, said thrust member being effective against said leaf spring during a swiveling movement of said control shaft in a closing direction of said sheet gripper.

2. Sheet gripper device according to claim 1, wherein said leaf spring, in an open position of said sheet gripper, is subject to a prestressing acting in an opening direction of said sheet gripper.

3. Sheet gripper device according to claim 1, wherein said leaf spring is secured by threaded fastening means at said other end thereof to the cylinder and extends through an opening formed in said control shaft.

4. Sheet gripper according to claim 3, wherein said side thereof having said fastening means is connected by crosspieces to said gripper tip.

5. Sheet gripper device according to claim 1, wherein said thrust member is disposed between said holding means and said leaf spring and is formed of a setscrew screwable in said holding means substantially perpendicularly to said leaf spring.

6. Sheet gripper device according to claim 5, wherein said setscrew is guidable in a recess formed in said leaf spring.

7. Sheet gripper device according to claim 6, wherein said setscrew has a contact surface formed thereon, and including an insert formed of material having limited elasticity disposed between said contact surface of said setscrew and said leaf spring.

8. Sheet gripper device according to claim 2, wherein said longitudinal swivel axis of said control shaft is spaced such a distance from a location at which said other end of said leaf spring is fastened on the cylinder that a swivel angle of said control shaft between one extreme position thereof wherein said gripper is open and another extreme position thereof wherein said gripper is closed corresponds to a change in an angle of a bending line of said leaf spring.

9. Sheet gripper device according to claim 1, wherein said leaf spring, in plan view, has a substantially triangular profile, with said fastened other end thereof being wider than said end opposite thereto whereon said gripper tip is located.

10. Sheet gripper device according to claim 9, wherein said fastened other end of said leaf spring is connected by crosspieces with said gripper tip.

11. Sheet gripper device according to claim 1, including a plurality of mutually spaced gripper tips disposed in a row adjacent one another and formed on a common leaf spring.

12. Sheet gripper device according to claim 11, wherein said leaf spring is formed of a continuous foot portion at said other end thereof fastened to the cylinder, and at least respective pairs of crosspieces connecting said foot portion with each of said gripper tips.

* * * * *